US009640145B2

(12) United States Patent
Cho

(10) Patent No.: US 9,640,145 B2
(45) Date of Patent: May 2, 2017

(54) DISPLAY APPARATUS AND CONTROLLING METHOD THEREOF

(71) Applicant: SAMSUNG ELECTRONICS CO., LTD., Suwon-si (KR)

(72) Inventor: Young-gwi Cho, Osan-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 44 days.

(21) Appl. No.: 14/700,581

(22) Filed: Apr. 30, 2015

(65) Prior Publication Data

US 2015/0317949 A1 Nov. 5, 2015

(30) Foreign Application Priority Data

May 2, 2014 (KR) ..... 10-2014-0053439

(51) Int. Cl.

| | |
|---|---|
| ***G09G 3/36*** | (2006.01) |
| ***G09G 5/14*** | (2006.01) |
| ***G09G 3/00*** | (2006.01) |

(52) U.S. Cl.

CPC ..... *G09G 5/14* (2013.01); *G09G 3/003* (2013.01); *G09G 2300/04* (2013.01);
(Continued)

(58) Field of Classification Search

USPC ... 345/31, 88, 102, 156, 173, 175, 204, 420, 345/647, 90, 419, 648, 690; 340/932.2;
(Continued)

(56) References Cited

U.S. PATENT DOCUMENTS

2002/0149613 A1 10/2002 Gutta et al.
2003/0146893 A1* 8/2003 Sawabe ..... G09G 3/3614 345/89

(Continued)

FOREIGN PATENT DOCUMENTS

EP 2674807 A1 12/2013
KR 10-2007-0088575 A 8/2007

(Continued)

OTHER PUBLICATIONS

Search Report dated Jul. 28, 2015, issued by the International Searching Authority in counterpart International Application No. PCT/KR2015/004244 (PCT/ISA/210).

(Continued)

*Primary Examiner* — Thuy Pardo
(74) *Attorney, Agent, or Firm* — Sughrue Mion, PLLC

(57) ABSTRACT

A display apparatus is provided. The display apparatus includes: a detector configured to detect one or more user viewing positions; a display configured to have a changeable curvature; and a controller receiving information of the one or more user viewing positions from the detector, the controller configured to determine deviations between right-side viewing angles and left-side viewing angles at each of the one or more detected user viewing positions for a first curvature and a second curvature of the display; and the controller configured to set the changeable curvature of the display based on the deviation determinations between the right-side viewing angle and the left-side viewing angle.

21 Claims, 17 Drawing Sheets

(52) U.S. Cl.
CPC ..... *G09G 2320/028* (2013.01); *G09G 2320/0261* (2013.01); *G09G 2320/068* (2013.01); *G09G 2354/00* (2013.01); *G09G 2380/02* (2013.01)

(58) Field of Classification Search
USPC ..... 348/59; 428/174
See application file for complete search history.

(56) References Cited

U.S. PATENT DOCUMENTS

| | | | | |
|---|---|---|---|---|
| 2006/0192739 | A1* | 8/2006 | Shin | G09G 3/3607 345/90 |
| 2008/0246762 | A1* | 10/2008 | Ogata | G06T 17/10 345/420 |
| 2009/0058845 | A1 | 3/2009 | Fukuda et al. | |
| 2009/0189917 | A1* | 7/2009 | Benko | G06F 3/14 345/647 |
| 2009/0289962 | A1* | 11/2009 | Jun | G09G 3/3413 345/690 |
| 2010/0253543 | A1* | 10/2010 | Szczerba | B60Q 9/005 340/932.2 |
| 2010/0309298 | A1* | 12/2010 | Muijs | G09G 3/3406 348/59 |
| 2011/0006979 | A1* | 1/2011 | Min | G02B 27/0093 345/156 |
| 2011/0148930 | A1 | 6/2011 | Lee et al. | |
| 2012/0075166 | A1 | 3/2012 | Marti et al. | |
| 2012/0092363 | A1* | 4/2012 | Kim | G06T 5/006 345/618 |
| 2012/0236118 | A1 | 9/2012 | Tsai et al. | |
| 2012/0256820 | A1 | 10/2012 | Uppuluri et al. | |
| 2013/0114193 | A1 | 5/2013 | Joo et al. | |
| 2013/0207946 | A1* | 8/2013 | Kim | G09G 3/3225 345/204 |
| 2013/0266771 | A1* | 10/2013 | Kusano | H05K 7/00 428/174 |
| 2014/0002419 | A1* | 1/2014 | Thorson | G06F 3/147 345/175 |
| 2015/0160501 | A1* | 6/2015 | Cope | G02F 1/133305 345/88 |
| 2016/0086373 | A1* | 3/2016 | Vesely | G06T 15/00 345/419 |

FOREIGN PATENT DOCUMENTS

| | | | |
|---|---|---|---|
| KR | 10-2013-0113826 | A | 10/2013 |
| KR | 10-2013-0117110 | A | 10/2013 |
| KR | 10-2014-0000831 | A | 1/2014 |
| WO | 02/071315 | A2 | 9/2002 |

OTHER PUBLICATIONS

Written Opinion dated Jul. 28, 2015, issued by the International Searching Authority in counterpart International Application No. PCT/KR2015/004244 (PCT/ISA/237).

Communication dated Sep. 6, 2015, issued by the Korean Intellectual Property Office in counterpart Korean Application No. 10-2014-0053439.

Communication dated Sep. 25, 2015, issued by the European Patent Office in counterpart European Application No. 15165788.9.

Communication dated Jan. 12, 2017, issued by the European Patent Office in counterpart European Patent Application No. 15165788.9.

* cited by examiner

FIG. 5

| H | A | D | R | a | d | h | ② | ① | Deviation |
|---|---|---|---|---|---|---|---|---|---|
| 1218.1 | 56 | 1000 | 3000 | 23.3 | 61.6 | 1209.7 | 55 | 54 | 1 |
| 1218.1 | 56 | 1000 | 4000 | 17.4 | 46.3 | 1213.4 | 52 | 57 | 5 |
| 1218.1 | 56 | 1000 | 5000 | 14.0 | 37.0 | 1215.1 | 50 | 58 | 8 |

FIG. 7

| Position | Inch | H | s | A | D | R | a | d | h | ② | ① | Deviation |
|---|---|---|---|---|---|---|---|---|---|---|---|---|
| 610 | 65.0 | 1439.6 | 1500.0 | 24.0 | 3369 | 3400 | 24.3 | 75.9 | 1428.8 | 26 | 22 | 4 |
| 620 | 65.0 | 1439.6 | 1000.0 | 17.0 | 3271 | 3400 | 24.3 | 75.9 | 1428.8 | 17 | 16 | 1 |
| 630 | 65.0 | 1439.6 | 800.0 | 14.0 | 3209 | 3400 | 24.3 | 75.9 | 1428.8 | 14 | 14 | 0 |
| 640 | 65.0 | 1439.6 | -1200.0 | -17.0 | 3925 | 3400 | 24.3 | 75.9 | 1428.8 | -14 | -19 | 5 |
| Sum | | | | | | | | | | | | 9.94 |

FIG. 8

| Position | Inch | H | s | A | D | R | a | d | h | ② | ① | Deviation |
|---|---|---|---|---|---|---|---|---|---|---|---|---|
| 610 | 65.0 | 1439.6 | 1500.0 | 24.0 | 3369 | 3600 | 22.9 | 71.7 | 1430.0 | 25 | 22 | 2 |
| 620 | 65.0 | 1439.6 | 1000.0 | 17.0 | 3271 | 3600 | 22.9 | 71.7 | 1430.0 | 17 | 17 | 0 |
| 630 | 65.0 | 1439.6 | 800.0 | 14.0 | 3209 | 3600 | 22.9 | 71.7 | 1430.0 | 13 | 14 | 1 |
| 640 | 65.0 | 1439.6 | -1200.0 | -17.0 | 3925 | 3600 | 22.9 | 71.7 | 1430.0 | -15 | -19 | 4 |
| Sum | | | | | | | | | | | | 7.58 |

FIG. 9

| Position | Inch | H | s | A | D | R | a | d | h | ② | ① | Deviation |
|---|---|---|---|---|---|---|---|---|---|---|---|---|
| 610 | 65.0 | 1439.6 | 1500.0 | 24.0 | 3369 | 3800 | 21.7 | 68.0 | 1431.0 | 24 | 23 | 1 |
| 620 | 65.0 | 1439.6 | 1000.0 | 17.0 | 3271 | 3800 | 21.7 | 68.0 | 1431.0 | 16 | 17 | 1 |
| 630 | 65.0 | 1439.6 | 800.0 | 14.0 | 3209 | 3800 | 21.7 | 68.0 | 1431.0 | 12 | 15 | 3 |
| 640 | 65.0 | 1439.6 | -1200.0 | -17.0 | 3925 | 3800 | 21.7 | 68.0 | 1431.0 | -16 | -18 | 2 |
| Sum | | | | | | | | | | | | 7.57 |

FIG. 10

| Position | Inch | H | s | A | D | R | a | d | h | ② | ① | Deviation |
|---|---|---|---|---|---|---|---|---|---|---|---|---|
| 610 | 65.0 | 1439.6 | 1500.0 | 24.0 | 3369 | 4000 | 20.6 | 64.6 | 1431.8 | 24 | 24 | 0 |
| 620 | 65.0 | 1439.6 | 1000.0 | 17.0 | 3271 | 4000 | 20.6 | 64.6 | 1431.8 | 15 | 18 | 2 |
| 630 | 65.0 | 1439.6 | 800.0 | 14.0 | 3209 | 4000 | 20.6 | 64.6 | 1431.8 | 12 | 15 | 4 |
| 640 | 65.0 | 1439.6 | -1200.0 | -17.0 | 3925 | 4000 | 20.6 | 64.6 | 1431.8 | -16 | -17 | 1 |
| Sum | | | | | | | | | | | | 7.56 |

FIG. 11

| Position | Inch | H | s | A | D | R | a | d | h | ② | ① | Deviation |
|---|---|---|---|---|---|---|---|---|---|---|---|---|
| 610 | 65.0 | 1439.6 | 1500.0 | 24.0 | 3369 | 4200 | 19.6 | 61.5 | 1432.5 | 23 | 24 | 1 |
| 620 | 65.0 | 1439.6 | 1000.0 | 17.0 | 3271 | 4200 | 19.6 | 61.5 | 1432.5 | 15 | 18 | 3 |
| 630 | 65.0 | 1439.6 | 800.0 | 14.0 | 3209 | 4200 | 19.6 | 61.5 | 1432.5 | 11 | 16 | 5 |
| 640 | 65.0 | 1439.6 | -1200.0 | -17.0 | 3925 | 4200 | 19.6 | 61.5 | 1432.5 | -17 | -17 | 0 |
| Sum | | | | | | | | | | | | 9.26 |

FIG. 12

| Position | Inch | H | s | A | D | R | a | d | h | ② | ① | Deviation |
|---|---|---|---|---|---|---|---|---|---|---|---|---|
| 610 | 65.0 | 1439.6 | 1500.0 | 24.0 | 3369 | 4400 | 18.7 | 58.7 | 1433.2 | 23 | 24 | 2 |
| 620 | 65.0 | 1439.6 | 1000.0 | 17.0 | 3271 | 4400 | 18.7 | 58.7 | 1433.2 | 14 | 19 | 4 |
| 630 | 65.0 | 1439.6 | 800.0 | 14.0 | 3209 | 4400 | 18.7 | 58.7 | 1433.2 | 11 | 16 | 5 |
| 640 | 65.0 | 1439.6 | -1200.0 | -17.0 | 3925 | 4400 | 18.7 | 58.7 | 1433.2 | -17 | -16 | 0 |
| Sum | | | | | | | | | | | | 12.02 |

DISPLAY APPARATUS AND CONTROLLING METHOD THEREOF

CROSS-REFERENCE TO RELATED APPLICATIONS

This application claims priority from Korean Patent Application No. 10-2014-0053439, filed on May 2, 2014, in the Korean Intellectual Property Office, the disclosure of which is incorporated herein by reference in its entirety.

BACKGROUND

Field

Apparatuses and methods consistent with the exemplary embodiments relate to a display apparatus and a controlling method thereof, and more particularly, to a display apparatus and a controlling method thereof capable of changing a curvature of a display.

Description of the Related Art

With development of electronic technology, various types of electronic products have been developed and spread. Particularly, various display apparatuses such as a television (TV), a mobile phone, a personal computer (PC), a laptop computer, and a personal digital assistant (PDA) are used in most households.

With the increased use of display apparatuses, user needs for various functions have increased. Therefore, manufacturers have dedicated significant effort to satisfy such user needs. As a result, products having new functions that were not present in the related art have been successively launched.

As an example, a display apparatus in which the left and the right sides of a display are curved provides an enlarged a viewing angle for a viewer when compared with a flat type display apparatus. The enlarged viewing angle enhances a user's viewing experience by allowing fuller visual immersion.

However, a viewer positioned off-center or at a side of the display apparatus having the curved left and the right sides experiences a visual distortion. The displayed image is more distorted as a viewing angle increases.

Therefore, the need for obtaining an optimal radius of curvature for the left and right sides of a curved display has increased. A display according to an exemplary embodiment is capable of minimizing a viewing angle distortion problem in consideration of one or more viewer positions and changing a curvature of the display depending on the optimal radius of curvature.

SUMMARY

One or more exemplary embodiments may overcome the above disadvantages and other disadvantages not described above. However, an apparatus or method consistent with an exemplary embodiment is not required to overcome the disadvantages described above, and an exemplary embodiment may not overcome any of the problems described above.

One or more exemplary embodiments provide a display apparatus and a controlling method thereof capable of changing a curvature of a display in order to decrease distortion viewed by a user at a viewing angle.

According to an aspect of an exemplary embodiment, there is provided a display apparatus including: a detector configured to detect one or more user viewing positions; a display configured to have a changeable curvature; and a controller receiving information of the one or more user viewing positions from the detector, the controller configured to determine deviations between right-side viewing angles and left-side viewing angles at each of the one or more detected user viewing positions for a first curvature and a second curvature of the display; and the controller configured to set the changeable curvature of the display to one of the first and second curvatures based on deviation determinations between the right-side viewing angles and the left-side viewing angles.

The controller may be configured to determine that a curvature of the display at which the deviation determinations becomes minimum is an optimal curvature of the display, and to set the curvature of the display to the optimal curvature.

The controller may be configured to determine sums of the deviations determined for plural user viewing positions for at least the first and second curvature and to determine that a curvature at which the sum of the deviations becomes minimum is an optimal curvature of the display.

The controller may be configured to set the curvature of the display to the first curvature to determine the deviations between the right-side viewing angles and the left-side viewing angles at each of the one or more user viewing positions, and to set the curvature of the display to the second curvature to determine the deviations between the right-side viewing angles and the left-side viewing angles at each of the one or more user viewing positions.

The controller may be configured to determine viewing angles of each user viewing position based on sight lines directed from each of the one or more user viewing positions towards the detector, to determine viewing distances of each user viewing position to the detector, and to determine the deviations between the right-side viewing angles and the left-side viewing angles at each user viewing position based on each of the determined viewing angles and viewing distances, wherein each of the viewing distances is a distance between a first plane including the detector and a second plane including at least one of the user viewing positions, wherein the first and second planes are parallel to each other.

The viewing angle (A) may be determined by the following Equation:

$$\text{Viewing Angle}=\tan^{-1}(S/D),$$

where S indicates a length from the user viewing position to the detector in a horizontal direction, and D is the viewing distance.

The right-side viewing angle may be determined by the following Equation:

$$\text{Right-side Viewing Angle}=\tan^{-1}((D*\tan(A)+h/2)/(D-d))-a/2,$$

and the left-side viewing angle may be determined by the following Equation:

$$\text{Left-side Viewing Angle}=\tan^{-1}((D*\tan(A)-h/2)/(D-d))+a/2,$$

where D indicates the viewing distance, A indicates the viewing angle, h indicates a length of the display as measured along a circumferential direction from a right distal end to a left distal end of the display, d indicates a length of the display in a depth direction from at least one of the right and left distal end to a central portion of the display, and a indicates a curvature angle of the display.

The sums of the deviations determined for the one or more user viewing positions may be determined by the following Equation:

$$\text{Sum of Deviation}=\Sigma_{p=x_1}^{X_n}(\text{ABS(Right-side Viewing Angle)}-\text{ABS(Left-side viewing Angle)})$$

for at least the first and second curvature, where $X_n$ represents an $n^{th}$ user viewing position and Right-side Viewing Angle=$\tan^{-1}$ ((D*tan(A)+h/2)/(D−d))−a/2, and the left-side viewing angle is determined by the following Equation:

$$\text{Left-side Viewing Angle}=\tan^{-1}((D*\tan(A)-h/2)/(D-d))+a/2$$

where D indicates the viewing distance, A indicates the viewing angle, h indicates a length of the display as measured along a circumferential direction from a right distal end to a left distal end of the display, d indicates a length of the display in a depth direction from at least one of the right and left distal end to a central portion of the display, and a indicates a curvature angle of the display.

The display may include a plurality of adjacent blocks, and the controller may be configured to apply pressure having a magnitude corresponding to the first or second curvature to the plurality of blocks to change a distance between adjacent blocks, thereby changing the curvature of the display.

According to another aspect of the present invention, as an exemplary embodiment, there is provided a controlling method of a display apparatus including: detecting one or more user viewing positions; determining deviations between right-side viewing angles and left-side viewing angles at each of the one or more detected user viewing positions for at least a first and second display curvature; and changing curvature of a display to one of the first and second display curvatures depending on the deviations determining step.

In changing the curvature, a curvature at which the deviation determination becomes minimum set as the curvature of the display.

In changing the curvature, sums of the deviations determined for plural detected user viewing positions may be determined for at least the first and second curvature, and a curvature at which the sum of the deviations becomes minimum may be set as the curvature of the display.

In the determining, the curvature of the display may be set to the first curvature to determine the deviations between the right-side viewing angles and the left-side viewing angles at each of the one or more detected user viewing positions, and the curvature of the display may be set to the second curvature to determine the deviations between the right-side viewing angles and the left-side viewing angles at each of the one or more detected user viewing positions.

In the determining, viewing angles of each user viewing position may be determined based on sight line directed from each of the one or more detected user viewing positions towards a detector configured to detect the user viewing positions, viewing distances of each user viewing position, and the deviations between the right-side viewing angles and the left-side viewing angles at each user viewing position may be determined based on each of the determined viewing angles and viewing distances, wherein each of the viewing distances is a distance between a first plane including the detector and a second plane including at least one of the one or more user viewing positions, wherein the first and second planes are parallel to each other.

The viewing angle (A) may be is determined by the following Equation:

$$\text{Viewing Angle}=\tan^{-1}(S/D),$$

where S indicates a length from the user viewing position to the detector in a horizontal direction, and D is the viewing distance.

The right-side viewing angle may be determined by the following Equation:

$$\text{Right-side Viewing Angle}=\tan^{-1}((D*\tan(A)+h/2)/(D-d))-a/2,$$

and the left-side viewing angle may be determined by the following Equation:

$$\text{Left-side Viewing Angle}=\tan^{-1}((D*\tan(A)-h/2)/(D-d))+a/2,$$

where D indicates the viewing distance, A indicates the viewing angle, h indicates a length of the display as measured along a circumferential direction from a right distal end to a left distal end of the display, d indicates a length of the display in a depth direction from at least one of the right and left distal end to a central portion of the display, and a indicates a curvature angle of the display.

The sums of the deviations determined for the one or more detected user viewing positions may be determined by the following Equation:

$$\text{Sum of Deviation}=\sum_{p=x_1}^{X_n}(\text{ABS(Right-side Viewing Angle)}-\text{ABS(Left-side viewing Angle)})$$

for at least the first and second curvature, where $X_n$ represents an $n^{th}$ viewer position and $$\text{Right-side Viewing Angle}=\tan^{-1}((D*\tan(A)+h/2)/(D-d))-a/2,$$

the left-side viewing angle is determined by the following Equation:

$$\text{Left-side Viewing Angle}=\tan^{-1}((D*\tan(A)-h/2)/(D-d))+a/2$$

where D indicates the viewing distance, A indicates the viewing angle, h indicates a length of the display as measured along a circumferential direction from a right distal end to a left distal end of the display, d indicates a length of the display in a depth direction from at least one of the right and left distal end to a central portion of the display, and a indicates a curvature angle of the display.

In changing the curvature, pressure having a magnitude corresponding to the first and second curvature may be applied to a plurality of adjacently disposed blocks included in the display to change a distance between adjacent blocks, thereby changing the curvature of the display.

A display apparatus according to an exemplary embodiment includes: a detector configured to detect one or more user viewing positions; a display configured to have a changeable curvature; a controller receiving information of the one or more viewing positions from the detector and configured to determine distortion associated with the at least one or more user viewing positions and to set a curvature of the display to minimize distortion of the display as viewed from the one or more user viewing positions.

The controller determines a sum of distortion values for plural user viewing positions and determines that a display curvature at which the sum of distortion values become minimum is set as a minimum distortion display curvature.

The display includes a plurality of adjacent blocks, and the controller applies pressure having a magnitude corresponding to the minimum distortion display curvature to the plurality of blocks to change a distance between adjacent blocks, thereby changing the curvature of the display.

BRIEF DESCRIPTION OF THE DRAWINGS

The above and/or other aspects will be more apparent by describing certain exemplary embodiments with reference to the accompanying drawings, in which:

FIGS. 4 and 5 are diagrams for describing a process of determining a curvature for one viewing position according to an exemplary embodiment;

FIGS. 6 to 12 are diagrams for describing a process of determining a curvature in consideration of a plurality of viewing positions according to an exemplary embodiment;

DETAILED DESCRIPTION

Hereinafter, exemplary embodiments will be described in more detail with reference to the accompanying drawings. Further, a detailed description for known functions or configurations which may obscure relevant description of the exemplary embodiments is omitted. One skilled in the art would understand that functions in the exemplary embodiments may be construed or implemented in different ways. Therefore, the description herein should not be construed as limiting.

Figure 1:
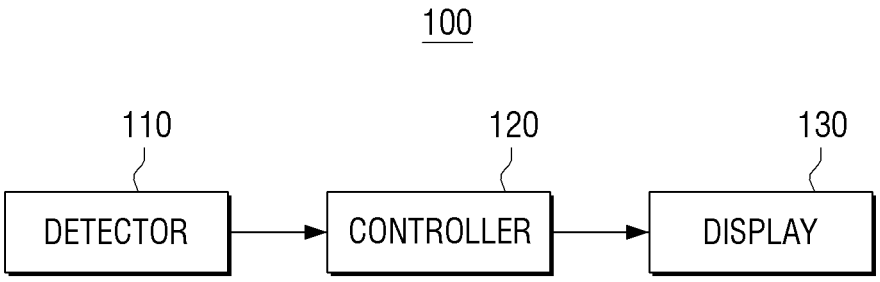
FIG. 1 is a block diagram illustrating a configuration of a display apparatus according to an exemplary embodiment.

FIG. 1 is a block diagram illustrating a configuration of a display apparatus according to an exemplary embodiment.

As illustrated in FIG. 1, a display apparatus 100 may be configured to include a detector 110, a controller 120, and a display 130. Here, the display apparatus 100 may be included in various types of electronic apparatus such as a television (TV), an electronic board, an electronic table, a large format display (LFD), a smart phone, a tablet personal computer (PC), a desktop PC, a laptop computer, and other devices having a display.

The detector 110 may detect one or more viewing positions. Here, the viewing position describes a position of a viewer viewing the display apparatus 100. In detail, the detector 110 may be implemented by a camera, an infrared ray (IR) sensor, or other type of detector.

When the detector 110 is implemented by a camera, the detector 110 may detect the viewing position of the viewer based on a focal length which would be used to photograph the viewer in an in-focus state. The camera may include one or more optical detectors or detector arrays or range-finding detectors and associated processors. When the detector 110 is implemented by the IR sensor, the detector 110 may detect the viewing position of the viewer based on a region on which an infrared ray is reflected, a time in which a returned infrared ray is received, among other measurements.

Further, the detector 110 may be disposed at any position of the display apparatus. The detector may be disposed at each corner, an upper end, or a lower end of the display apparatus 100. The display apparatus can include one or more detectors.

The display 130 has a predetermined curvature or alternately described by radius of curvature by bending the left or right of a display from a flat state. Here, the curvature or the radius of curvature is a value that may indicate a degree of a curve at each point of a curved surface. The larger the radius of curvature, the smoother the curved surface. The smaller the radius of curvature, the more pronounced the curve of the curved surface. The radius of curvature is often considered inversely related to curvature. However, one skilled in the art would understand that both may be appropriately used to describe the rate of curve of an object.

One skilled in the art would understand that both the curvature and the radius of curvature for the degree of the curve may be determined at a multiple of points of the curved surface.

In addition, the display 130 may include a display panel or screen (not illustrated) and a backlight unit (not illustrated), wherein operations or characteristics of the display panel (not illustrated) and the backlight unit (not illustrated) may be varied depending on a variation of the curvature. In the case where the display 130 is varied depending on a determined curvature, operations or characteristics of the display panel (not illustrated) and the backlight unit (not illustrated) may also be varied depending on the determined curvature.

The controller 120 may determine deviations between right-side viewing angles and left-side viewing angles at each of the one or more detected viewing positions for each curvature and change the curvatures of the display 130 depending on curvatures determined based on the deviations.

In the case where a user is positioned in front of the center portion of the display 130, a viewing angle becomes larger as compared with a flat display, such that an immersion experience is increased. However, in the case a user is positioned at a side of the display 130, or off-center from the display, distortion of viewing angles at left or right distal ends of the display 130 occurs.

In order to decrease the distortion of the viewing angles, the controller 120 determines the deviations between the right-side viewing angles and the left-side viewing angles at each of the one or more viewing positions detected by the detector 110 for each curvature.

Figure 2:
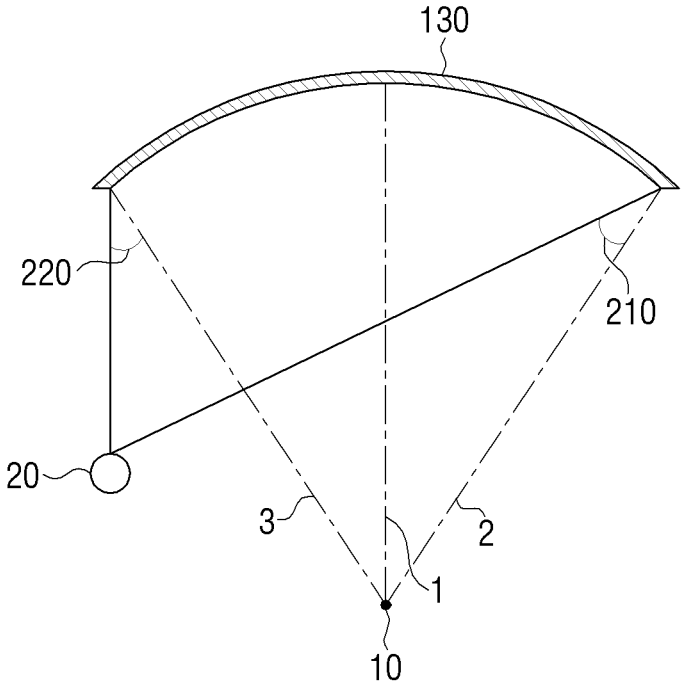
FIG. 2 is a diagram illustrating a right-side viewing angle and a left-side viewing angle for setting a curvature of a display according to an exemplary embodiment.

FIG. 2 is a diagram illustrating a right-side viewing angle and a left-side viewing angle for setting a curvature of a display according to an exemplary embodiment.

Referring to FIG. 2, the display 130 is bent to have a predetermined curvature, such that the display 130 may correspond to a portion of a circle having center 10. Therefore, a line 1 positioned in a direction perpendicular to a tangent line at a central region of the display 130, a line 2 positioned in a direction perpendicular to a tangent line of a right distal end of the display 130, and a line 3 positioned in a direction perpendicular to a tangent line of a left distal end of the display 130 are all a radius having the same length. The lines 1, 2, 3 meet each other at a central point 10 of the circle including the curve of display 130.

In addition, an angle 210 formed by a sight line direction from a viewing position 20 at which the user is positioned toward the right distal end of the display 130 and the line 2 positioned in the direction perpendicular to the tangent line of the right distal end of the display 130 is a right-side viewing angle, and an angle 220 formed by a sight line direction from the viewing position 20 at which the user is positioned toward the left distal end of the display 130 and the line 3 positioned in the direction perpendicular to the tangent line of the left distal end of the display 130 is a left-side viewing angle.

Meanwhile, the sight line direction from the viewing position 20 at which the user is positioned in relation to the right distal end of the display 130, and the sight line direction from the viewing position 20 at which the user is positioned in relation to the left distal end of the display 130 may be detected by the detector 110.

In addition, the controller 120 determines a deviation between the right-side viewing angle 210 and the left-side viewing angle 220 at the viewing position 20 at which the user is positioned. As the deviation between the right-side viewing angle 210 and the left-side viewing angle 220 at the viewing position 20 at which the user is positioned becomes smaller, distortion of the viewing angle at the viewing position 20 may be decreased.

In addition, the controller 120 may repeatedly determine deviations between the right-side viewing angles and the left-side viewing angles at each of one or more viewing positions detected by the detector 110 for each curvature.

In detail, the controller 120 sets the curvature of the display 130 to a first curvature to determine the deviations between the right-side viewing angles and the left-side viewing angles at each of one or more detected viewing positions.

For example, the controller 120 may set the radius of curvature of the display 130 to 3000 R (e.g., 3000 mm) and determine the deviations between the right-side viewing angles and the left-side viewing angles at one or more detected viewing positions.

Then, the controller 120 sets the curvature of the display 130 to a second curvature to determine the deviations between the right-side viewing angles and the left-side viewing angles at each of one or more detected viewing positions.

That is, the controller 120 may set the radius of curvature of the display 130 to 4000 R (e.g., 4000 mm) and determine the deviations between the right-side viewing angles and the left-side viewing angles at one or more detected viewing positions.

The curvature of the display may be set to the first curvature or the second curvature depending on the results of the deviations. As a further exemplary embodiment, the curvature of the display may be set to a curvature based on interpolated values between the first and second curvatures as a possible curvature setting for the display, depending on the deviations determined. A further embodiment may determine calculations between right-side viewing angles and left-side viewing angles at each of the one or more detected viewing positions.

The controller 120 may also determine a deviation between the right-side viewing angle and the left-side viewing angle as viewing position changes.

For example, when the user views the display apparatus 100 while moving in front of the display apparatus 100, the detector 110 may recognize that a viewing position of the user moves and may continuously detect a changed viewing position of the user. Therefore, the controller 120 may determine the deviations between the right-side viewing angles and the left-side viewing angles at each viewing position based on the change of the viewing position continuously detected from the detector 110. That is, the controller 120 may determine the deviations between the right-side viewing angles and the left-side viewing angles at each viewing position depending on the movement or the change of the viewing position in real time.

In addition, even in this case, the controller 120 may determine the deviations between the right-side viewing angles and the left-side viewing angles at each viewing position for each curvature in real time.

As described above, the controller 120 may determine deviations between the right-side viewing angles and the left-side viewing angles based on various curvatures of the display 130 and various detected viewing positions.

Next, a process of determining the deviation between the right-side viewing angle and the left-side viewing angle at the viewing position will be described in detail.

Figure 3:
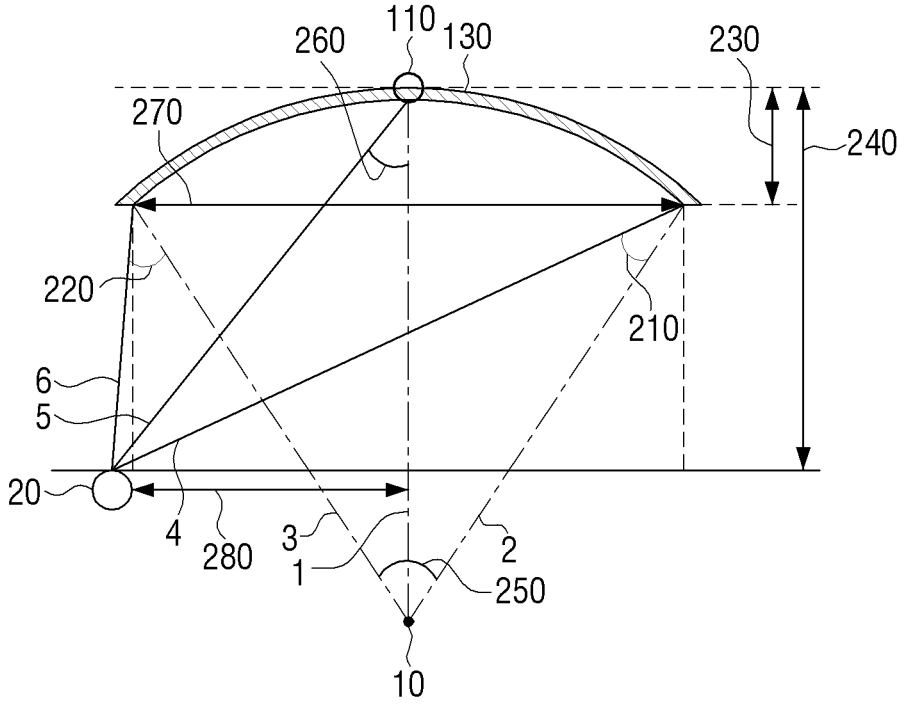
FIG. 3 is a diagram illustrating information to set the curvature of the display according to an exemplary embodiment.

FIG. 3 is a diagram illustrating information used to set the curvature of the display according to an exemplary embodiment.

Referring to FIG. 3, the detector 110, the display 130, the right-side viewing angle 210, the left-side viewing angle 220, a viewing distance 240, a curvature angle 250, a viewing angle 260, and a straight line length 270 of the display 130 in a horizontal direction are illustrated. In addition, a length 280 corresponds to a horizontal distance between the viewing position 20 and line projected from the detector 110 to a center 10. In addition, a length 230 is a straight line of measurement of the display 130 in a depth direction. The length 230 corresponds to the depth distance between the back surface of the display screen and one of the right or left distal ends of the display screen.

Here, as described with reference to FIG. 2, the right-side viewing angle 210 is the angle formed by the sight line direction 4 from the viewing position 20 detected by the detector 110 toward the right distal end of the display 130 and the line 2 positioned in the direction perpendicular to the tangent line of the right distal end of the display 130. The left-side viewing angle 220 is the angle formed by the sight line direction 6 from the viewing position 20 detected by the detector 110 toward the left distal end of the display 130 and the line 3 positioned in the direction perpendicular to the tangent line of the left distal end of the display 130.

The controller 120 may determine the viewing angles of each viewing position based on sight line directions from each of the one or more detected viewing positions.

In detail, referring to FIG. 3, the controller 120 may compare a sight line direction 5 from the detected viewing position 20 toward the detector 110 and a virtual line 1 positioned in a direction perpendicular to a tangent line at a central region of the display 130 in which the detector 110 is present. The sight line 5 and virtual line 1 may be used to determine the viewing angle 260 at the detected viewing position 20.

Here, information on the virtual line 1 positioned in the direction perpendicular to the tangent line of the region in which the detector 110 is present is stored in a storing unit (not illustrated). This information may comprise a radius distance, location of detector on the display, and information on the detector. The controller 120 determines the viewing angle 260 based on the information on the virtual line 1 positioned in the direction perpendicular to the tangent line of the region in which the detector 110 is present (stored in the storing unit), and information on the sight line direction 5 from the viewing position 20 detected by the detector 110 toward the detector 110.

In addition, the controller 120 may determine viewing distances of each viewing position by vertically connecting each of one or more detected viewing positions and a plane on which the detector 110 is positioned to each other as straight lines.

Referring to FIG. 3, the controller 120 may determine the viewing distance 240 based on a distance of a straight line vertically connecting the plane on which the detector 110 is positioned and the plane including the detected viewing position 20. Here the planes including the detector 110 and detected viewing position 20 are oriented to be perpendicular to the plane of the paper which illustrates FIG. 3, and the planes containing the detector 110 and the viewing position 20 are parallel to each other. In an exemplary embodiment, the plane containing the detector extends in a direction that would include a planar surface of the display screen, if the display were flat.

For example, in the case in which the detector 110 is a camera, when it is assumed that there is a lookup table storing information on the viewing distance 240 corresponding to each focal length, the detector 110 may also obtain information on the viewing distance 240 from the focal length. In particular, the viewing distance 240 corresponds to a focal length at which the user is accurately focused. Based on the lookup table relating focal length and distance, the viewing distance 240 can be determined. When the viewing position 20 is off-center, additional factors may be taken into account, such as an approximate degree of offset from a center-line, or distance to the detected viewing position 20. Other detector-based measurements can also be used to determine the distance to a viewing position of a user. These can be based on send and receive timings of a signal and other known techniques. The information collected from different detectors may also be used in combination.

Meanwhile, the controller 120 may determine the deviations between the right-side viewing angles and the left-side viewing angles at each viewing position based on each of the determined viewing angle and viewing distance.

Particularly, the viewing angle 260 may be determined by the following Equation 1.

$$\text{Viewing Angle}=\tan^{-1}(S/D) \quad \text{[Equation 1]}$$

Here, S indicates a length 280 from the viewing position to the detector 110 in the horizontal direction, and D indicates the viewing distance 240. One skilled in the art would understand that measurements needed to determine the view angle may be determined from the range-finding of the detectors in the detector or a combination of measurements and other geometric relationships between the lengths and angles. One skilled in the art would also understand angular measurements can be similarly determined either by direct measurement or application of relationships known to those skilled in the art. The use of these length and angular measurements or determinations provides an adjustment to the curvature of display, to eliminate distortive effects at different user viewing positions.

The viewing angle 260 may be changed by a change in the detected viewing position 20 and the viewing distance 240. Here, the controller 120 may determine the length 280 from the viewing position to the detector 110 in the horizontal direction based on the information on the virtual line 1 positioned in the direction perpendicular to the tangent line of the region in which the detector 110 is present, stored in the storing unit (not illustrated) and the detected viewing position 20.

Meanwhile, the right-side viewing angle 210 may be determined by the following Equation 2.

$$\text{Right-Side Viewing Angle}=\tan^{-1}((D*\tan(A)+h/2)/(D-d))-a/2 \quad \text{[Equation 2]}$$

In addition, the left-side viewing angle 220 may be determined by the following Equation 3.

$$\text{Left-Side Viewing Angle}=\tan^{-1}((D*\tan(A)-h/2)/(D-d))+a/2 \quad \text{[Equation 3]}$$

Here, D indicates the viewing distance 240, A indicates the viewing angle 260, h indicates the straight line length 270 of the display 130 in the horizontal direction, d indicates a measurement 230 of the display 130 in the depth direction, and a indicates the curvature angle 250. It would be understood that depth measurement d and curvature angle 250 are based on the radius of curvature set for the display at the time of measurement by the detector 110.

Meanwhile, a, which is the curvature angle 250, is an angle formed by the line 2 connecting the central point 10 of the circle corresponding to the curvature of the display 130 and the right distal end of the display 130 and the line 3 connecting the central point 10 of the circle corresponding to the curvature of the display 130 and the left distal end of the display 130. The curvature angle a may be determined by the following Equation 4.

$$a=\text{rad}(H/R) \quad \text{[Equation 4]}$$

Here, H means an actual horizontal length of the display 130. That is, the actual length of the display 130 having a curved shape is the same as a length of an arc, which is a portion of a circle corresponding to the curvature of the display 130. It is the length of that portion of the circumference of the circle, which is defined by the radius of curvature.

In addition, R means a radius of the circle that best corresponds to the curvature of the display 130. In an exemplary embodiment, this is the same as a distance from the central point 10 of the circle to the display 130 at its central region. In addition, in an exemplary embodiment this is the same as the radius of curvature.

In addition, when a value obtained by dividing the actual length of the display 130 by the curvature of radius is represented by rad, that is, a radian, the curvature angle 250 may be determined (in radians).

Meanwhile, d, which is the measurement 230 in the depth direction of the display 130, may be determined by the following Equation 5.

$$d=R(1-\cos(a/2)) \quad \text{[Equation 5]}$$

The controller 120 may determine the depth measurement 230 of the display 130 through the above Equation 5 using the curvature angle 250 and the radius R of curvature determined through the above Equation 4.

In addition, h, which is the straight line length 270 of the display 130 in the horizontal direction, may be determined by the following Equation 6.

$$h=2*R\sin(a/2) \quad \text{[Equation 6]}$$

Here, the straight line length 270 of the display 130 in the horizontal direction means a straight line distance between the left or right distal ends of the displays 130 and is different from the actual length (H) of the display 130.

The controller 120 may determine the right-side viewing angles and the left-side viewing angles at each of the detected viewing positions through the above Equations 2 and 3 and determine deviations between the determined right-side viewing angles and left-side viewing angles.

In addition, the controller 120 may determine the curvature based on the deviations. Here, the curvature determined based on the deviations means a curvature capable of minimizing the distortion at the viewing angle. In detail, the controller 120 may determine that a curvature at which the deviation becomes minimum will be the new curvature setting of the display 130. This will be described with reference to FIGS. 4 and 5.

Figure 4:
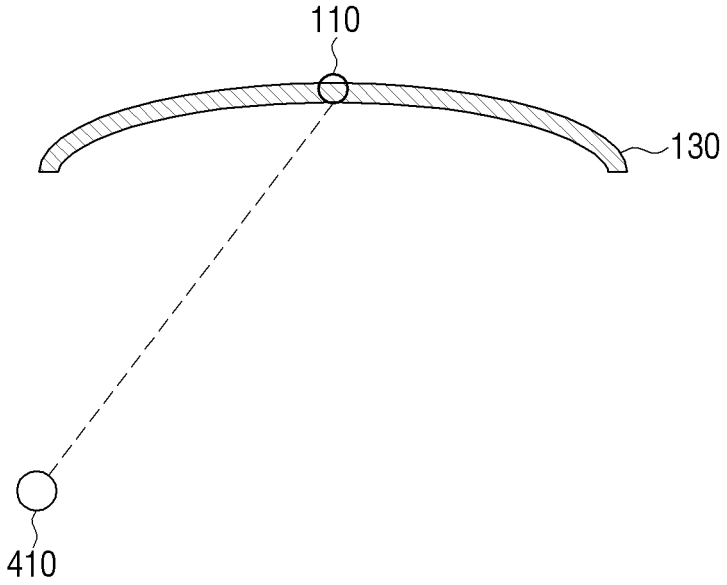

FIGS. 4 and 5 are diagrams for describing a process of determining a curvature for one viewing position according to an exemplary embodiment.

Referring to FIG. 4, the display 130 and the detector 110 attached to the display 130 are illustrated. Here, the detector 110 may detect a viewing position 410 of the viewer. In addition, the controller 120 may determine a viewing angle and a viewing distance for the detected viewing position 410 and determine a deviation between a right-side viewing angle and a left-side viewing angle for the detected viewing position based on the determined viewing angle and viewing distance. In addition, the controller 120 may determine deviations between the right-side viewing angles and the left-side viewing angles for the detected viewing positions depending on various curvatures of the display 130.

FIG. 5 illustrates a table in which deviations between right-side viewing angles and left-side viewing angles determined under the assumption that a size of the display 130 is 55 inches and a curvature thereof is 3000 R, 4000 R, and 5000 R are arranged. (Note 3000 R corresponds to a radius of curvature of 3000 mm.)

In detail, H means the actual length of the display 130, A means the viewing angle 260, D means the viewing distance 240, R indicates curvature or the radius of curvature 1, 2, or 3, a means the curvature angle 250, d means the depth measurement 230 of the display 130, h means the straight line length 270 of the display 130 in the horizontal direction, ① means the right-side viewing angle 210, ② means the left-side viewing angle 220, and Deviation means the deviation between the right-side viewing angle 210 and the left-side viewing angle 220, which is a deviation between ① and ②.

Since Deviation is 1 when the curvature is 3000 R, is 5 when the curvature is 4000 R, and 8 when the curvature is 5000 R, the controller 120 may determine that 3000 R should be the curvature of the display. This is because among the listed curvatures, a curvature of 3000 R corresponds to minimum Deviation.

Meanwhile, according to another exemplary embodiment, the controller 120 may determine the sums of deviations determined for more than one detected viewing positions for each curvature and determine that a curvature at which the sum of the deviations becomes minimum should be the curvature of the display 130.

That is, in the case in which a plurality of viewers view the display apparatus at a plurality of viewing positions, in order to minimize distortion of viewing angles at the plurality of viewing positions, the controller 120 determines the sums of deviations determined for the plurality of viewing positions. The deviation determinations are performed for each curvature and the controller sets a curvature at which the sum of the deviations becomes minimum as an optimal curvature of the display 130.

Here, the sums of the deviations determined for the plurality of detected viewing positions may be determined by the following Equation 7 for each curvature.

$$\text{Sum of Deviation} = \sum_{p=x_1}^{x_n} (\text{ABS(Right-side Viewing Angle)} - \text{ABS(Left-side viewing Angle)}) \quad \text{[Equation 7]}$$

Here, p means each of the plurality of viewing positions. According to the above Equation 7, all of the deviations between the right-side viewing angles and the left-side viewing angles for each of the plurality of viewing positions are summed up. In addition, the controller 120 repeatedly sums up the deviations between the right-side viewing angles and the left-side viewing angles for each of the plurality of viewing positions through the above Equation 7 for each curvature.

In addition, in the case in which signs +/− are used in order to distinguish viewing positions on the right-hand side of the detector 110 and on the left-hand side of the detector from each other, an absolute value ABS is used. This allows the proper consideration of the deviation amounts from viewing positions on the left and right of the detector.

Therefore, with the radius of curvature at which the sum of the deviations becomes minimum, distortion of viewing angles at the plurality of viewing positions present in a certain region becomes minimum. The region in which the viewing positions will be analyzed can also be set by user preference. For instance, if a user too near, too far or too off-center from the screen, the position of such a detected user view position may not be included in the sum, as such may overly-distort the views of others. In detail, this will be described with reference to FIGS. 6 to 12.

FIGS. 6 to 12 are diagrams for describing a process of determining a curvature in consideration of a plurality of viewing positions according to an exemplary embodiment.

Figure 6:
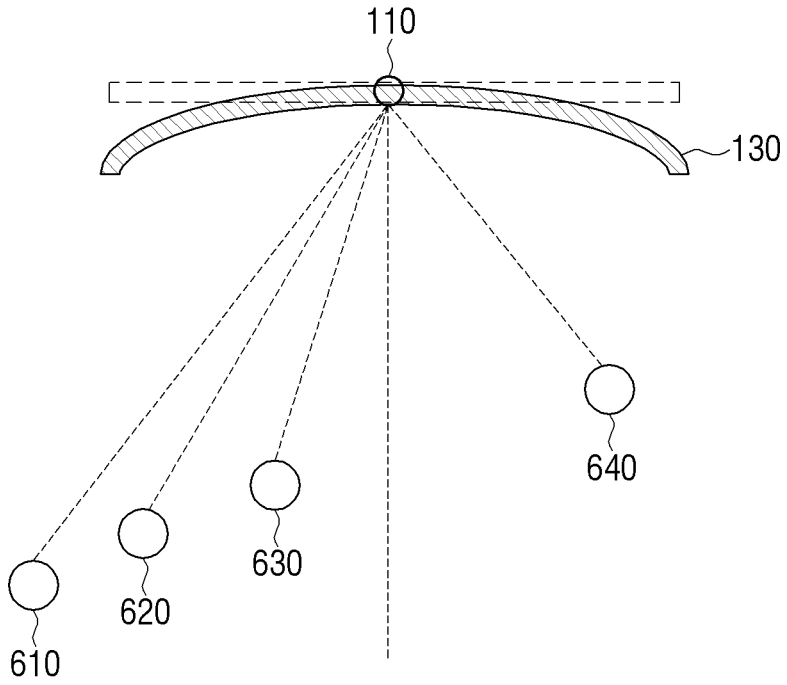

Referring to FIG. 6, the display 130 and the detector 110 attached to the display 130 are illustrated. Here, the detector 110 may detect viewing positions 610, 620, 630, and 640 of a plurality of viewers. In addition, the controller 120 may determine viewing angles and viewing distances for each of the plurality of detected viewing positions 610, 620, 630, and 640 and determine deviations between right-side viewing angles and left-side viewing angles for the plurality of detected viewing positions based on each of the determined viewing angles and viewing distances. In addition, the controller 120 may determine deviations between the right-side viewing angles and the left-side viewing angles for the detected viewing positions depending on various curvatures of the display 130.

FIG. 7 illustrates a table in which deviations between right-side viewing angles and left-side viewing angles at the plurality of viewing positions 610, 620, 630, and 640 in the case in which a size of the display 130 is 65 inches and a curvature thereof is 3400 R are arranged.

In detail, since H, A, D, R, a, d, h, ① and ② have been described with reference to FIG. 5, a detailed description therefor will be omitted. Meanwhile, s means the length 280 from the viewing position 20 to the detector 110 in the horizontal direction of FIG. 3. It may be appreciated that the lengths 280 from the plurality of viewing positions 610, 620, 630, and 640 to the detector 110 in the horizontal direction are set for example to 1500, 1000, 800, and −1200 in FIG. 7. Here, values 1500, 1000, and 800 having a positive sign correspond to the viewing positions present in a left region based on the central region of the display 130. Value −1200 having a negative sign corresponds to the viewing position present in a right region based on the central region of the display 130.

In addition, the viewing angles of each of the plurality of viewing positions 610, 620, 630, and 640 and the lengths from each of the plurality of viewing positions 610, 620, 630, and 640 to the detector 110 in the horizontal direction may be determined by the controller 120.

In addition, referring to FIG. 7, it may be appreciated that the sum of the deviations at the plurality of viewing positions 610, 620, 630, and 640 is 9.94 in the case in which the size of the display 130 is 65 inches and the curvature thereof is 3400 R.

FIG. 8 illustrates a table in which deviations between right-side viewing angles and left-side viewing angles at the plurality of viewing positions 610, 620, 630, and 640 in the case in which a size of the display 130 is 65 inches and a curvature thereof is 3600 R are arranged. Referring to FIG. 8, it may be appreciated that the sum of the deviations at the plurality of viewing positions 610, 620, 630, and 640 is 7.58.

Likewise, FIGS. 9 to 12 illustrate tables in which deviations between right-side viewing angles and left-side viewing angles at the plurality of viewing positions 610, 620, 630, and 640 in the cases in which sizes of the displays 130 are 65 inches and curvatures thereof are 3800 R, 4000 R, 4200 R, and 4400 R are arranged, respectively. Referring to FIGS. 9 to 12, it may be appreciated that the sums of the deviations at the plurality of viewing positions 610, 620, 630, and 640 are 7.57, 7.56, 9.26, and 12.02, respectively.

Therefore, it may be appreciated that the smallest value among the sums of the deviations at the plurality of viewing positions 610, 620, 630, and 640 illustrated in FIGS. 7 to 12 is 7.56 and a curvature when the sum of the deviations at the plurality of viewing positions 610, 620, 630, and 640 is 7.56 is 4000 R.

Therefore, the controller 120 may determine that 4000 R, where the sum of the deviations is minimum among the listed curvatures for multiple user viewing positions, should be the curvature of the display 130. In an exemplary embodiment, while each of the deviations was weighted equally, one skilled in the art would understand that the deviations may be weighted differently depending on the number of persons in different regions in front of the screen, a viewing configuration of the room, direction of ambient light or other viewing factors.

Meanwhile, although an example in which the controller 120 determines the sum of the deviations in order to determine the curvature of the display 130 has been described above, the controller 120 may also determine an average of the deviations or determine a standard deviation in order to determine the curvature of the display 130.

In addition, although an example in which the controller 120 determines the deviations between the right-side viewing angles and the left-side viewing angles at one or more fixed viewing positions has been described above, the controller 120 may also determine deviations between right-side viewing angles and left-side viewing angles as the one or more viewing positions changes.

For example, in the case in which a viewer views the display apparatus 100 while moving in front of the display apparatus 100, the detector 110 may recognize that the viewing position of a user moves to continuously detect the changed viewing position of the user. Therefore, the controller 120 may determine the deviations between the right-side viewing angles and the left-side viewing angles at each viewing position based on the change of the viewing position continuously detected from the detector 110.

That is, the controller 120 may determine the deviations between the right-side viewing angles and the left-side viewing angles at each viewing position depending on the movement or the change of a viewing position in real time.

In addition, even in this case, the controller 120 may determine the deviations between the right-side viewing angles and the left-side viewing angles at each viewing position for each curvature in real time.

Therefore, the controller 120 may change the curvature of the display 130 in real time based on the movement or the change of the viewing position. As discussed above, the weight given to detected moving user viewing positions may also be adjusted depending on other viewing characteristics present. In an exemplary embodiment, the amount of weighting can be configured by a user. For example, in a viewing situation where there is less likely to be movement around a room, such as a home theater, the movement of the detected user viewing position may be afforded less weight. On the other hand, in a sports event viewing party, the movement of user viewing positions may be more important and given more weight.

Meanwhile, according to still another exemplary embodiment, the controller 120 may determine deviations between right-side viewing angles and left-side viewing angles at one or more viewing positions for a flat display, determine deviations between right-side viewing angles and left-side viewing angles at one or more viewing positions for a curved display, determine the deviations between the right-side viewing angles and the left-side viewing angles at one or more viewing positions for the flat display and the deviations between the right-side viewing angles and the left-side viewing angles at one or more viewing positions for the curved display, and determine a curvature of the display 130 based on these deviations.

That is, the controller 120 may determine that a curvature in the case in which the difference value between the deviations between the right-side viewing angles and the left-side viewing angles at one or more viewing positions for the flat display and the deviations between the right-side viewing angles and the left-side viewing angles at the one or more viewing positions for the curved display becomes maximum should be the curvature of the display 130.

Meanwhile, the controller 120 may change the curvature of the display 130 depending on the determined curvature. In detail, the controller 120 may bend the display 130 depending on the curvature determined according to the above-mentioned exemplary embodiment. That is, the controller may change the screen curvature to an optimal curvature.

The display 130 may include a plurality of blocks disposed so as to be spaced apart from each other. The controller 120 may apply pressure having a magnitude corresponding to a determined curvature to the plurality of blocks to change a distance between adjacent blocks, thereby changing the curvature of the display 130.

Figure 13A:
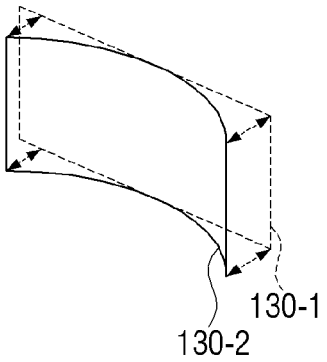
FIG. 13A is a diagram illustrating a configuration of a display according to an exemplary embodiment in a flat state and a curved state.

FIG. 13A is a diagram illustrating a configuration of a display according to an exemplary embodiment.

Referring to FIG. 13A, the display 130 may be bent from a flat state 130-1 to a curved state 130-2.

Figure 13B:
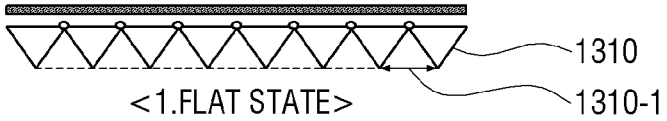
FIG. 13B illustrates an exemplary embodiment of a plural blocks of a display in a flat state.

Referring to FIG. 13B, the display 130 may include a plurality of blocks 1310 disposed so as to be spaced apart from each other by preset intervals 1310-1. FIG. 13B shows a configuration of the display to provide a screen in a flat state. The controller 120 may apply pressure between the plurality of blocks. In an exemplary embodiment, the plurality of blocks 1310 have a triangular cross section and share one vertex with a neighboring block.

Figure 13C:
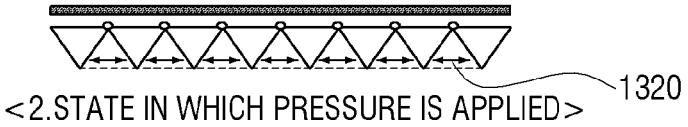
FIG. 13C illustrates an exemplary embodiment of plural blocks of a display with pressure applied.

Referring to FIG. 13C, when the controller 120 applies the pressure 1320 between the plurality of blocks, the intervals 1310-1 between the plurality of blocks to which the pressure is applied are increased. Here, the applied pressure shows an outward pressure exerted at a free-end of the blocks, as indicated by the directional arrows. With the application of the pressure, the plurality of blocks may be displaced from each other. This causes the display to take on a curved configuration.

Figure 13D:
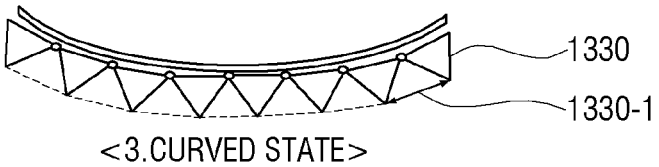
FIG. 13D illustrates an exemplary embodiment of plural blocks of a display in a curved state.

FIG. 13D shows a configuration of the blocks 1330 with the pressure applied. The resulting pressure provides a display 130 in a curved state.

According to the above-mentioned example, the controller 120 may apply the pressure having the magnitude corresponding to the determined curvature between the plurality of blocks, thereby changing the curvature of the display 130. One skilled in the art that a detector feedback as a pressure change or distal change between the blocks can be used at the controller to control the degree of block separation.

Figure 14A:
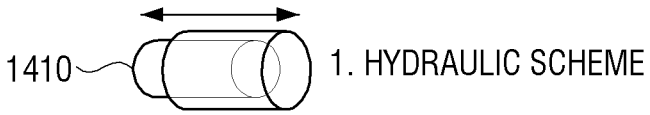
FIGS. 14A to 14C illustrate approaches for providing curvature to a display according to exemplary embodiments.
Figure 14B:
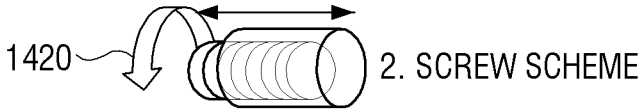
Figure 14C:
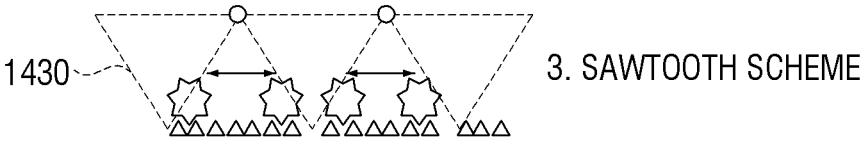

FIGS. 14A to 14C illustrate different mechanisms for applying pressure to introduce curve to a display according to an exemplary embodiment.

Referring to FIGS. 14A to 14C, the pressure 1320 applied between the plurality of blocks may be generated by a hydraulic scheme 1410 (FIG. 14A), a screw scheme 1420 (FIG. 14B), or a sawtooth scheme 1430 (FIG. 14C).

FIG. 14A illustrates a hydraulic approach for adjusting the pressure 1320 applied between the plurality of blocks as shown in FIG. 13B. In the hydraulic approach, the amount of exerted pressure depends on an amount of oil, water, or air introduced into a hydraulic structure disposed between the plurality of blocks. FIG. 14B illustrates a screw mechanism 1420. In the screw mechanism, a motor adjusts the pressure 1320 applied between the plurality of blocks depending on a rotation amount of the motor (not shown) configured with a driving screw. The amount of rotation determines the amount that threads of a screw engage with its counterpart to expand or contract a member disposed between the plural blocks of FIG. 13B. FIG. 14C illustrates a sawtooth scheme 1430. In a sawtooth approach, a chain with saw teeth is disposed between the plurality of blocks to adjust a rotation number of the saw teeth, thereby adjusting the pressure 1320 applied between the plurality of blocks.

Meanwhile, the generation of the pressure 1320 of FIG. 13C applied between the plurality of blocks is not limited to the above-mentioned exemplary embodiments.

In addition, the display 130 may include a plurality of small motors, and the controller 120 may control each of the plurality of small motors to bend the left/right of the display 130, thereby changing the curvature of the display 130.

Figure 15:
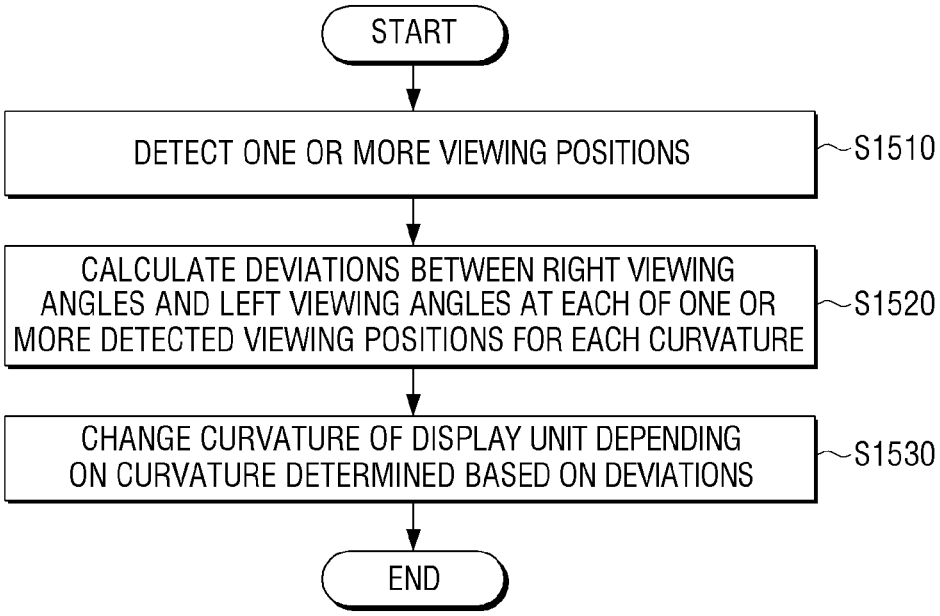
FIG. 15 is a flow chart for describing a controlling method of a display apparatus according to an exemplary embodiment.

FIG. 15 is a flow chart for describing a controlling method of a display apparatus according to an exemplary embodiment.

According to the controlling method illustrated in FIG. 15, the one or more viewing positions may be detected (S1510).

Then, the deviations between the right-side viewing angles and the left-side viewing angles at each of the one or more detected viewing positions may be determined for each curvature of the display (S1520).

Here, in S1520, the curvature of the display may be set to a first curvature to determine the deviations between the right-side viewing angles and the left-side viewing angles at each of the one or more detected viewing positions, and the curvature of the display may be set to a second curvature to determine the deviations between the right-side viewing angles and the left-side viewing angles at each of one or more detected viewing positions.

In addition, in S1520, the viewing angles of each viewing position may be determined based on the sight line directions from each of one or more detected viewing positions, the viewing distances of each viewing position may be determined by vertically connecting a respective plane including each of one or more detected viewing positions and the plane on which the detector is positioned. The plane containing the viewing position and the plane containing the detector should be parallel to each other, and the viewing distance is the distance between the planes. This determination of viewing distance is applied for each viewing position plane, relative to the plane containing the detector. Further, the deviations between the right-side viewing angles and the left-side viewing angles at each viewing position may be determined based on each of the determined viewing angles and viewing distances.

Here, the viewing angles are determined by the above Equation 1. In the above Equation 1, S indicates the length 280 from the viewing position to the detector in the horizontal direction, and D indicates the viewing distance.

In addition, the right-side viewing angles are determined by the above Equation 2, and the left-side viewing angles are determined by the above Equation 3. In the above Equations 2 and 3, D indicates the viewing distance, A indicates the viewing angle, h indicates the straight line length of the display in the horizontal direction, d indicates a measurement of the display in a depth direction, and a indicates the curvature angle.

Then, the curvature of the display may be changed depending on the curvature determined based on the deviations (S1530).

Here, in S1530, the curvature at which the deviation becomes minimum may be determined to be the curvature of the display.

In addition, in S1530, the sums of the deviations determined for one or more detected viewing positions may be determined for each curvature, and the curvature at which the sum of the deviations becomes minimum may be determined to be the curvature of the display.

Here, the sums of the deviations determined for one or more detected viewing positions may be determined by the above Equation 7 for each curvature.

In addition, in S1530, the pressure having the magnitude corresponding to the determined curvature may be applied to the plurality of blocks included in the display to change the distance between the adjacent blocks, thereby changing the curvature of the display.

Figure 16:
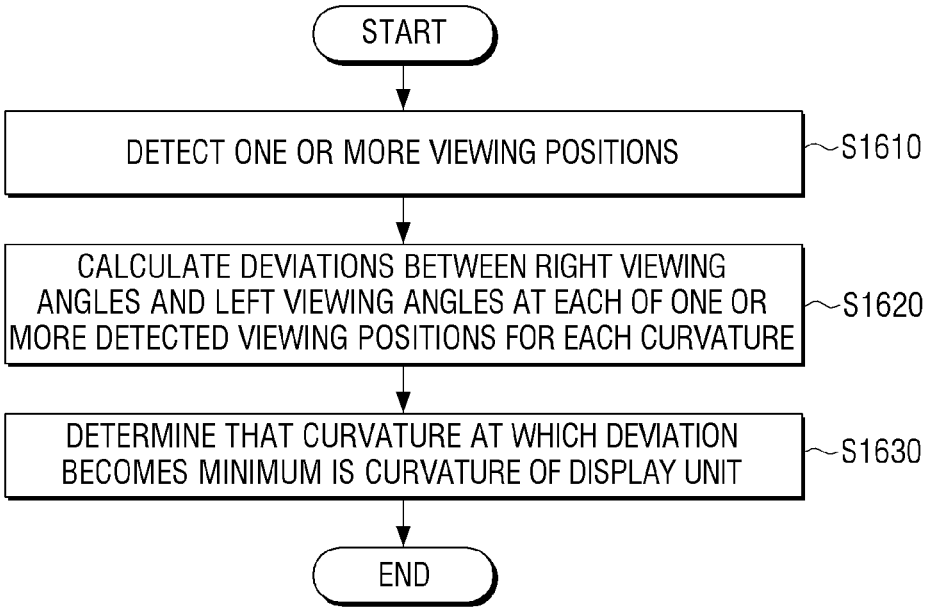
FIG. 16 is a flow chart for describing a method of determining a curvature of a display according to an exemplary embodiment.

FIG. 16 is a flow chart for describing a method of determining a curvature of a display according to another exemplary embodiment.

According to the method illustrated in FIG. 16, one or more viewing positions are detected (S1610).

Then, the deviations between the right-side viewing angles and the left-side viewing angles at each of the one or more detected viewing positions are determined for each curvature (S1620).

In addition, the curvature at which the deviation becomes minimum is determined to be the curvature of the display (S1630).

Figure 17:
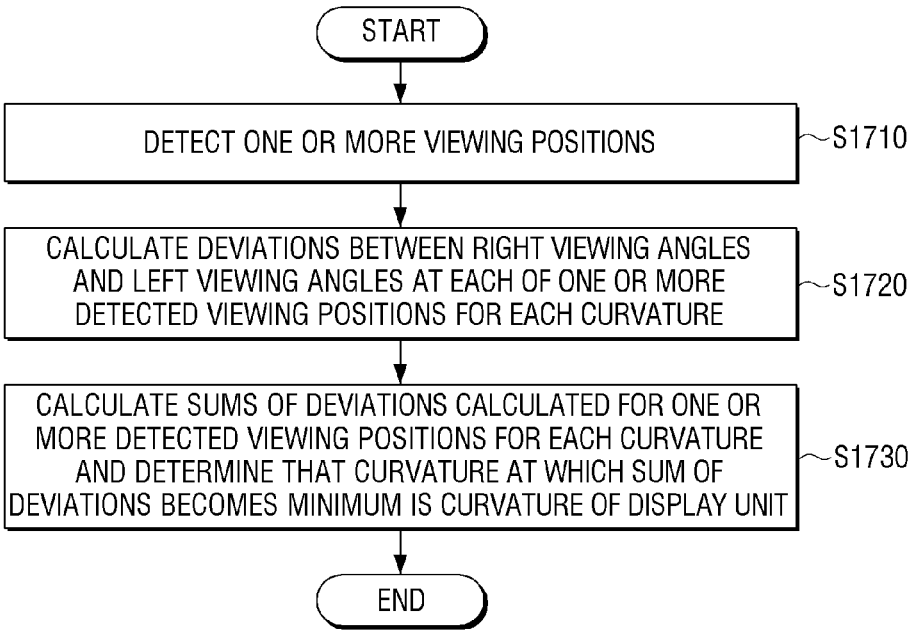
FIG. 17 is a flow chart for describing a method of determining a curvature of a display according to another exemplary embodiment.

FIG. 17 is a flow chart for describing a method of determining a curvature of a display according to another exemplary embodiment.

According to the method illustrated in FIG. 17, one or more viewing positions are detected (S1710).

Then, the deviations between the right-side viewing angles and the left-side viewing angles at each of the one or more detected viewing positions are determined for each curvature (S1720).

Then, the sums of the deviations determined for the one or more detected viewing positions are determined for each curvature, and the curvature at which the sum of the deviations becomes minimum is determined to be the curvature of the display (S1730).

Meanwhile, a non-transitory computer readable medium storing a program which sequentially performs the controlling method according to exemplary embodiments may be provided.

As an example, a non-transitory computer readable medium stores a program performing a process of detecting the one or more viewing positions and a process of determining the deviations between the right-side viewing angles and the left-side viewing angles at each of the one or more detected viewing positions for each curvature may be provided.

The non-transitory computer readable medium includes a medium that semi-permanently stores data therein and is readable by a device. In detail, various applications or programs described above may be stored and provided in the non-transitory computer readable medium such as a compact disk (CD), a digital versatile disk (DVD), a hard disk, a Blu-ray disk, a universal serial bus (USB), a memory card, a read only memory (ROM).

In addition, although buses are not illustrated in the block diagram of the display apparatus, communication between the respective components in the display apparatus may be performed through the buses. In addition, a processor such as a central processing unit (CPU), a microprocessor, performing various processes described above may be further included in each device, including the detector, the controller, and the display.

As set forth above, according to various exemplary embodiments of the present disclosure, an optimal screen curvature which decreases distortion of the viewing angle may be determined in consideration of the one or more viewing positions of the viewer, and the curvature of the display may be changed depending on the determined optimal curvature. While the curvatures described herein have been described as left and right oriented, one skilled in the art would understand that alternate or additional orientations for curvature may also be considered.

While the exemplary embodiment describes a centrally disposed detector, one skilled in the art would understand the modifications needed to place one or more detectors in other orientations and locations.

Although exemplary embodiments have been illustrated and described hereinabove, the scope of invention is not limited to the above-mentioned specific exemplary embodiments, but may be variously modified by those skilled in the art to which the disclosure pertains without departing from the scope and spirit of the invention as disclosed in the accompanying claims. These modifications should also be understood to fall within the scope of the invention.

What is claimed is:

1. A display apparatus comprising:

a detector configured to detect one or more user viewing positions;

a display configured to have a changeable curvature; and a controller configured to receive information of the one or more user viewing positions from the detector, determine deviations between right-side viewing angles and left-side viewing angles at each of the one or more detected user viewing positions for a first curvature and a second curvature of the display, and set the changeable curvature of the display based on the determined deviations between the right-side viewing angles and the left-side viewing angles, each of the right-side viewing angles is an angle formed by a sight line direction from the viewing position at which a respective -user is positioned toward a right distal end of the display and a line positioned in a direction perpendicular to a tangent line of the right distal end of the display, and each of the left-side viewing angles is an angle formed by a sight line direction from the viewing position at which the respective user is positioned toward a left distal end of the display and a line positioned in a direction perpendicular to a tangent line of the left distal end of the display.

2. The display apparatus as claimed in claim 1, wherein the controller is configured to determine that a curvature of the display at which the deviation becomes minimum is an optimal curvature of the display, and set the curvature of the display to the optimal curvature.

3. The display apparatus as claimed in claim 1, wherein the controller is configured to determine sums of the deviations determined for plural user viewing positions for at least the first and second curvature, and determine that a curvature at which the sum of the deviations becomes minimum is an optimal curvature of the display.

4. The display apparatus as claimed in claim 3, wherein the sums of the deviations determined for the one or more user viewing positions are determined by the following Equation:

$$\text{Sum of Deviation} = \sum_{p=x_1}^{x_n} (\text{ABS(Right-side Viewing Angle)} - \text{ABS(Left-side viewing Angle)})$$

for at least the first and second curvature, where $X_n$ represents an $n^{th}$ user viewing position and $$\text{Right-side Viewing Angle} = \tan^{-1}((D*\tan(A)+h/2)/(D-d))-a/2, \text{ and}$$

the left-side viewing angle is determined by the following Equation:

$$\text{Left-side Viewing Angle} = \tan^{-1}((D*\tan(A)-h/2)/(D-d))+a/2$$

where D indicates the viewing distance, A indicates the viewing angle, h indicates a length of the display as measured along a circumferential direction from a right distal end to a left distal end of the display, d indicates a length of the display in a depth direction from at least one of the right and left distal end to a central portion of the display, and a indicates a curvature angle of the display.

5. The display apparatus as claimed in claim 1, wherein the controller is configured to set the curvature of the display to the first curvature to determine the deviations between the right-side viewing angles and the left-side viewing angles at each of the one or more user viewing positions, and set the curvature of the display to the second curvature to determine the deviations between the right-side viewing angles and the left-side viewing angles at each of the one or more user viewing positions.

6. The display apparatus as claimed in claim 5, wherein the controller is configured to determine viewing angles of each user viewing position based on sight lines directed from each of the one or more user viewing positions towards the detector, determine viewing distances of each user viewing position to the detector, and determine the deviations between the right-side viewing angles and the left-side viewing angles at each user viewing position based on each of the determined viewing angles and viewing distances, wherein each of the viewing distances is a distance between a first plane including the detector and a second plane including at least one of the one or more user viewing positions, wherein the first and second planes are parallel to each other.

7. The display apparatus as claimed in claim 6, wherein the viewing angle (A) is determined by the following Equation:

$$\text{Viewing Angle} = \tan^{-1}(S/D)$$

where S indicates a length from the user viewing position to the detector in a horizontal direction, and D is the viewing distance.

8. The display apparatus as claimed in claim 7, wherein the right-side viewing angle is determined by the following Equation:

$$\text{Right-side Viewing Angle} = \tan^{-1}((D*\tan(A)-h/2)/(D-d))-a/2,$$

and the left-side viewing angle is determined by the following Equation:

$$\text{Left-side Viewing Angle} = \tan^{-1}((D*\tan(A)-h/2)/(D-d))+a/2$$

where D indicates the viewing distance, A indicates the viewing angle, h indicates a length of the display as measured along a circumferential direction from a right distal end to a left distal end of the display, d indicates a length of the display in a depth direction from at least one of the right and left distal end to a central portion of the display, and a indicates a curvature angle of the display.

9. The display apparatus as claimed in claim 1, wherein the display includes a plurality of adjacent blocks, and the controller is configured to apply pressure having a magnitude corresponding to the first curvature or the second curvature to the plurality of blocks to change a distance between adjacent blocks, thereby changing the curvature of the display.

10. A controlling method of a display apparatus, the controlling method comprising:

detecting one or more user viewing positions;

determining deviations between right-side viewing angles and left-side viewing angles at each of the one or more detected user viewing positions for at least a first curvature and a second curvature of a display of the display apparatus; and setting curvature of the display based on the determined deviations, each of the right-side viewing angles is an angle formed by a sight line direction from the viewing position at which a respective user is positioned toward a right distal end of the display and a line positioned in a direction perpendicular to a tangent line of the right distal end of the display, and each of the left-side viewing angles is an angle formed by a sight line direction from the viewing position at which the respective user is positioned toward a left distal end of the display and a line positioned in a direction perpendicular to a tangent line of the left distal end of the display.

11. The controlling method of a display apparatus as claimed in claim 10, wherein in the setting the curvature, a curvature at which one of the determined deviations becomes minimum is set as the curvature of the display.

12. The controlling method of a display apparatus as claimed in claim 10, wherein in the setting the curvature comprises determining sums of the deviations determined for plural detected user viewing positions for at least the first and second curvature, and setting a curvature at which the sum of the deviations becomes minimum as the curvature of the display.

13. The controlling method of a display apparatus as claimed in claim 12, wherein the sums of the deviations determined for the one or more detected user viewing positions are determined by the following Equation:

$$\text{Sum of Deviation} = \sum_{p=x_1}^{X_n} (\text{ABS(Right-side Viewing Angle)} - \text{ABS(Left-side viewing Angle)})$$

for at least the first and second curvature, where $X_n$ represents an $n^{th}$ viewer position and $$\text{Right-side Viewing Angle} = \tan^{-1}((D*\tan(A)+h/2)/(D-d))-a/2,$$

and the left-side viewing angle is determined by the following Equation:

$$\text{Left-side Viewing Angle} = \tan^{-1}((D*\tan(A)-h/2)/(D-d))+a/2$$

where D indicates the viewing distance, A indicates the viewing angle, h indicates a length of the display as measured along a circumferential direction from a right distal end to a left distal end of the display, d indicates a length of the display in a depth direction from at least one of the right and left distal end to a central portion of the display, and a indicates a curvature angle of the display.

14. The controlling method of a display apparatus as claimed in claim 10, wherein the determining the deviations comprises setting the curvature of the display to the first curvature to determine the deviations between the right-side viewing angles and the left-side viewing angles at each of the one or more detected user viewing positions, and setting the curvature of the display to the second curvature to determine the deviations between the right-side viewing angles and the left-side viewing angles at each of the one or more detected user viewing positions.

15. The controlling method of a display apparatus as claimed in claim 14, wherein the determining the deviations comprises: determining viewing angles of each user viewing position based on sight lines directed from each of the one or more detected user viewing positions towards a detector configured to detect the user viewing positions, viewing distances of each user viewing position, and determining the deviations between the right-side viewing angles and the left-side viewing angles at each user viewing position based on each of the determined viewing angles and viewing distances, wherein each of the viewing distances is a distance between a first plane including the detector and a second plane including at least one of the one or more user viewing positions, wherein the first and second planes are parallel to each other.

16. The controlling method of a display apparatus as claimed in claim 15, wherein the viewing angle (A) is determined by the following Equation:

$$\text{Viewing Angle} = \tan^{-1}(S/D)$$

where S indicates a length from the user viewing position to the detector in a horizontal direction, and D is the viewing distance.

17. The controlling method of a display apparatus as claimed in claim 15, wherein the right-side viewing angle is determined by the following Equation:

$$\text{Right-side Viewing Angle} = \tan^{-1}((D*\tan(A)+h/2)/(D-d))-a/2,$$

and the left-side viewing angle is determined by the following Equation:

$$\text{Left-side Viewing Angle} = \tan^{-1}((D*\tan(A)-h/2)/(D-d))+a/2$$

where D indicates the viewing distance, A indicates the viewing angle, h indicates a length of the display as measured along a circumferential direction from a right distal end to a left distal end of the display, d indicates a length of the display in a depth direction from at least one of the right and left distal end to a central portion of the display, and a indicates a curvature angle of the display.

18. The controlling method of a display apparatus as claimed in claim 10, wherein in changing the curvature, pressure having a magnitude corresponding to the first and second curvature is applied to a plurality of adjacently disposed blocks included in the display to change a distance between adjacent blocks, thereby changing the curvature of the display.

19. A display apparatus comprising:

a detector configured to detect one or more user viewing positions;

a display configured to have a changeable curvature;

a controller configured to receive information of the one or more viewing positions from the detector, determine distortion associated with the at least one or more user viewing positions based on a right-side viewing angle and a left-side viewing angle, and set a curvature of the display to minimize distortion of the display as viewed from the one or more user viewing positions, the right-side viewing angle is an angle formed by a sight line direction from the viewing position at which the user is positioned toward a right distal end of the display and a line positioned in a direction perpendicular to a tangent line of the right distal end of the display, and the left-side viewing angle is an angle formed by a sight line direction from the viewing position at which the user is positioned toward a left distal end of the display and a line positioned in a direction perpendicular to a tangent line of the left distal end of the display.

20. The display apparatus of claim 19, wherein the controller is configured to determine a sum of distortion values for plural user viewing positions, and determine that a display curvature at which the sum of the determined distortion values becomes minimum is set as a minimum distortion display curvature.

21. The display apparatus of claim 20, wherein the display includes a plurality of adjacent blocks, and the controller is configured to apply pressure having a magnitude corresponding to the minimum distortion display curvature to the plurality of blocks, and change a distance between adjacent blocks, thereby changing the curvature of the display.

* * * * *